US006679619B2

(12) United States Patent
Saieva

(10) Patent No.: US 6,679,619 B2
(45) Date of Patent: Jan. 20, 2004

(54) HIGH INTENSITY DISCHARGE (HID) LAMP WITH INTEGRAL BALLAST AND UNDERWATER LIGHTING SYSTEMS INCORPORATING SAME

(76) Inventor: Carl Saieva, 17 Sands La., Port Jefferson, NY (US) 11777

( * ) Notice: Subject to any disclaimer, the term of this patent is extended or adjusted under 35 U.S.C. 154(b) by 0 days.

(21) Appl. No.: 09/783,767

(22) Filed: Feb. 15, 2001

(65) Prior Publication Data

US 2001/0033134 A1 Oct. 25, 2001

Related U.S. Application Data

(60) Provisional application No. 60/183,767, filed on Feb. 18, 2000.

(51) Int. Cl.[7] ..... F21V 29/00

(52) U.S. Cl. ..... 362/263; 362/261; 362/264; 362/267; 313/491

(58) Field of Search ..... 362/263, 265, 362/158, 22, 261, 267, 264, 538; 315/56–59, 94, 291; 313/491

(56) References Cited

U.S. PATENT DOCUMENTS 5,089,945 A * 2/1992 Mula ..... 362/261
5,105,346 A * 4/1992 Acks et al. ..... 362/267
5,144,201 A 9/1992 Graham et al. ..... 313/634

* cited by examiner

*Primary Examiner*—Sandra O'Shea
*Assistant Examiner*—Bao Truong
(74) *Attorney, Agent, or Firm*—Galgano & Burke

(57) ABSTRACT

A portable battery powered high intensity lighting system that produces solar quality illumination at four to six times the efficiency of comparable incandescent lighting systems includes a light head and a power source. The light head contains an HID (high intensity discharge) arc lamp. A sealed enclosure containing a ballast is attached immediately adjacent to the lamp assembly. The ballast enclosure is preferably potted with a thermally conductive epoxy.

14 Claims, 4 Drawing Sheets

HIGH INTENSITY DISCHARGE (HID) LAMP WITH INTEGRAL BALLAST AND UNDERWATER LIGHTING SYSTEMS INCORPORATING SAME

This application claims the benefit of provisional application Ser. No. 60/183,767, filed Feb. 18, 2000, the complete disclosure of which is hereby incorporated by reference herein.

BACKGROUND OF THE INVENTION

1. Field of the Invention

The invention relates to lamps and lighting systems for use underwater by divers. More particularly, the invention relates to an HID lamp with integral ballast and underwater lighting systems incorporating the same.

2. Brief Description of the Prior Art

Underwater exploration is virtually impossible without the aid of some type of artificial lighting system. Even under broad daylight, when diving beyond a certain depth, the natural light from the sun is severely affected by the water. In addition to loss of light intensity, the water produces spectral changes in the light to the extent that color is not readily recognizable and the view underwater appears to be only bluish black and white. Moreover, even at relatively shallow depths, artificial lighting is necessary to see objects in shadows or in crevices. Exploration of caves and shipwrecks is impossible without bright artificial lighting systems.

The simplest lighting systems utilize ordinary incandescent lamps powered by rechargeable batteries. Ordinary incandescent lamps are inefficient and produce a limited spectrum which is unsuitable for photography, particularly under water. Halogen lamps provide a much higher intensity than ordinary incandescent lamps and also provide a balanced spectrum which can be used with certain types of film to accurately capture colors in underwater photographs. For example, many halogen lamps are balanced to a color temperature of 3200° K., and some film emulsions are designed to be used with illumination with this spectrum. Filters are also available for use with daylight (6500° K.) balanced emulsions and 3200° K. light sources.

Although the halogen lamps are an improvement over ordinary incandescent lamps, they share some of the disadvantages of ordinary incandescent lamps and have some disadvantages of their own. Both kinds of lamps rely on the heating of a filament by an electric current passing through the filament. In order to produce more light output and a higher color temperature, more current must be provided to the filament. This requires either a larger battery or results in a shorter "burn life". Since divers are burdened with enough equipment to begin with, a large battery pack is certainly undesirable. Filament lamps also have the disadvantage that the filament is easily damaged by thermal or mechanical shock.

A new type of lamp referred to as a high intensity discharge (HID) lamp is disclosed in U.S. Pat. No. 5,144,201 (the complete disclosure of which is hereby incorporated by reference herein) and is generally available from Welch Allyn, Inc. (Skaneateles Falls, N.Y.). The lamp contains an anode and a cathode and a mixture of mercury, argon and other chemicals. The anode and the cathode are coupled to a ballast having a DC power input. When a DC voltage (9–16 VDC) is applied to the power input of the ballast, the ballast begins a start-up sequence. The ballast first produces a series of high voltage (25 KV) high frequency (33 KHZ) pulses that ionize the gases inside the lamp. During this sequence the ballast monitors the resistance of the lamp. When the gases have been sufficiently excited, an arc is struck across the anode and cathode. After the arc is struck, the ballast applies a reduced DC voltage to the anode and cathode of approximately 60 VDC. The ballast continuously monitors the resistance of the lamp and controls the current to the lamp in order to maintain the arc and prevent overdriving. The color of the light produced by the HID lamp is determined by the mix of material (compounds and/or gases) contained in the lamp and the extent to which they are excited by the continuing current. Typically, the color temperature is in the range of 4700–6500° K.

The HID lamps provided by Welch Allyn and others are not particularly designed for use under water. Many manufacturers intend that these lamps be used in automotive applications and in image projection applications such as projection television. For a variety of reasons, Welch Allyn recommends that the lamp and ballast be located apart from each other. In most applications, this does not present a problem. However, in an underwater lighting system, location of the ballast apart from the lamp can be problematic. The typical underwater lighting system includes a battery pack which is coupled by a cable to a hand-held lamp assembly. If the ballast is not located adjacent to the lamp assembly, it must be located adjacent to the battery pack. The battery pack is typically strapped to the diver's torso, arm or leg. In order for the lamp assembly to be freely positionable, the cable connecting the lamp assembly to the battery pack must be sufficiently long. It has been discovered, however, that if the cable length from the ballast to the lamp assembly is more than approximately 18 inches, the lamp may not reliably startup.

SUMMARY OF THE INVENTION

It is therefore an object of the invention to provide a lamp for an underwater lighting system and an underwater lighting system incorporating the same.

It is also an object of the invention to provide a lamp for an underwater lighting system which has a high color temperature.

It is another object of the invention to provide a lamp for an underwater lighting system which is energy efficient.

It is yet another object of the invention to provide a lamp for an underwater lighting system which can be coupled to a battery pack via a relatively long cable or integrated into single hand-held unit composed of a lamp, ballast and battery.

It is another object of the invention to provide underwater lighting systems incorporating the lamp described above.

In accord with these objects, which will be discussed in detail below, the lamp according to the invention includes an hermetically sealed quartz glass envelope containing an anode, a cathode, and mixture of ionizable elements and/or compounds. A sealed ballast container is mounted immediately adjacent to the glass envelope. A ballast is located in the sealed container and is electrically coupled to the anode and cathode. The ballast input is preferably coupled to a standard type of connector so that the lamp may be retrofitted to an existing lighting system. A lighting system according to the invention includes the lamp and ballast assembly described above, a battery pack, and a cable electrically coupling the ballast to the battery pack. Eight embodiments of the lamp and ballast assembly are provided for use with different lighting systems. One type of connector is disclosed for permanently coupling the lamp and ballast assembly to a single battery pack. Another type of connector is disclosed which permits under water swapping of battery packs.

DETAILED DESCRIPTION

Figure 1A:
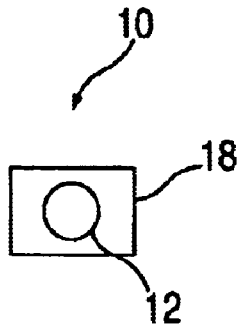
FIG. 1*a* is an end view of the lamp and ballast assembly of FIG. 1.
Figure 1:
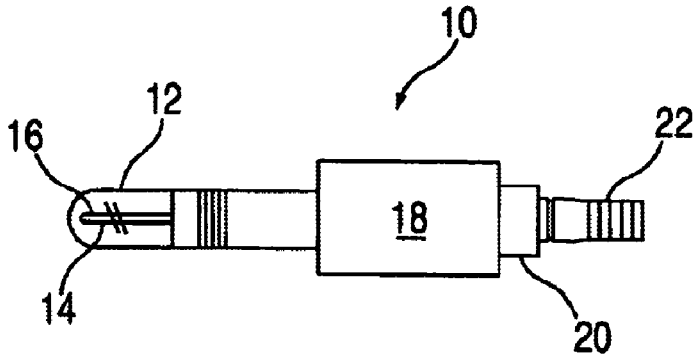
FIG. 1 is a side elevation view of a first embodiment of a lamp and ballast assembly according to the invention.
Figure 1B:
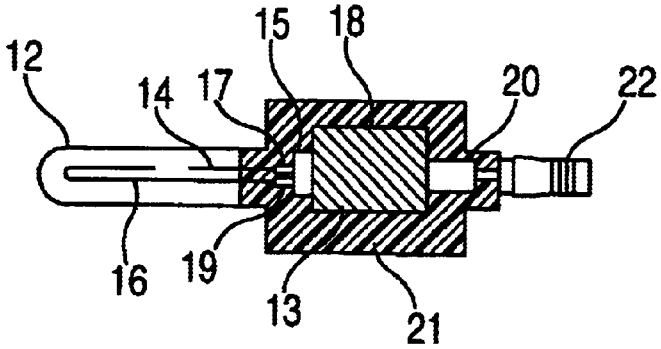
FIG. 1*b* is a schematic representation of the lamp and ballast assembly of FIG. 1*a*.
Figure 10:
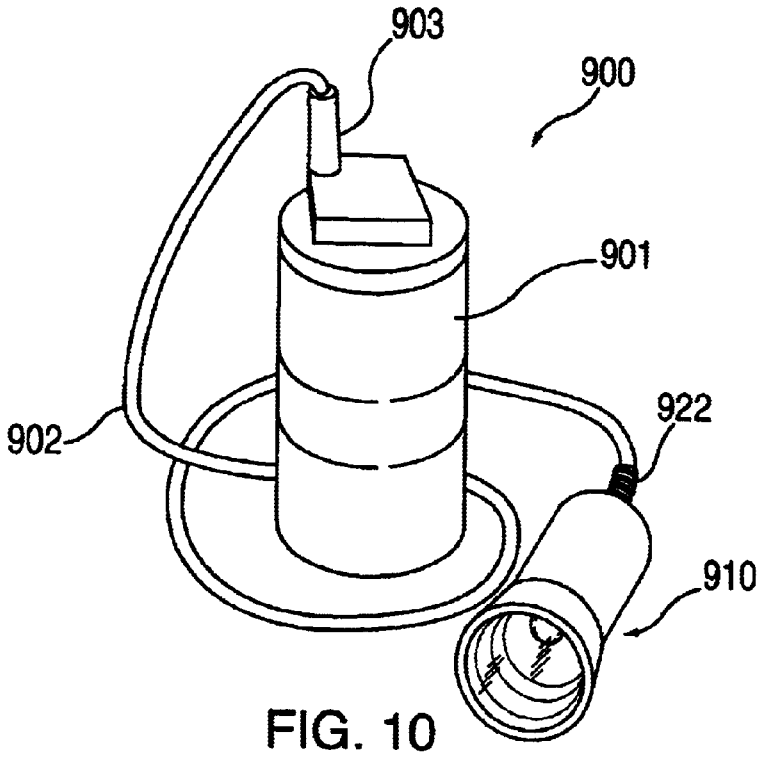
FIG. 10 is a perspective view of a lighting system according to the invention.

Turning now to FIGS. 1 and 1*a*, a lamp 10 according to the invention includes a hermetically sealed quartz glass envelope 12 containing an anode 14, a cathode 16, and mixture of ionizable elements and/or compounds (not shown). A sealed ballast container 18 is mounted immediately adjacent to the glass envelope 12. As shown in FIG. 1*b*, an electronic ballast 13 (schematically illustrated) having an input 20 and an output 15 is located in the sealed container 18 and its output 15 is electrically coupled to the anode 14 and cathode 16 via poles 17, 19 respectively. The ballast container 18 typically made of metal and/or plastic is preferably potted with a thermally conductive (electrically-non conductive) epoxy insulator 21 which serves as a heat sink to discharge heat from the unit. Alternatively, other heat sink arrangements (not shown) to dissipate heat from the ballast can be used. The ballast input 20 is preferably coupled to a standard type of connector (FIGS. 7 and 8 described below) so that the lamp 10 may be retro-fitted to an existing lighting system or a DC power source 901 via coupling means or cable 902 (FIG. 10). As shown in FIG. 1, a portion of the connector (otherwise not shown) includes a strain relief 22. As shown in FIG. 1*a*, the ballast container 18 is rectangular in configuration. According to this embodiment, the lamp 10 is a 10–30 watt lamp, has an overall length of about 8 3/16 inches and a maximum width of about 2 3/16 inches.

Figure 2A:
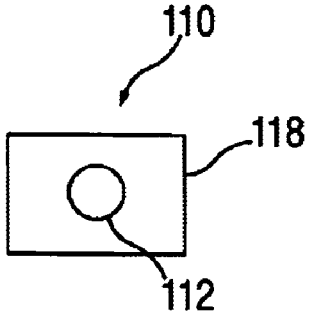
FIG. 2*a* is an end view of the lamp and ballast assembly of FIG. 2.
Figure 2:
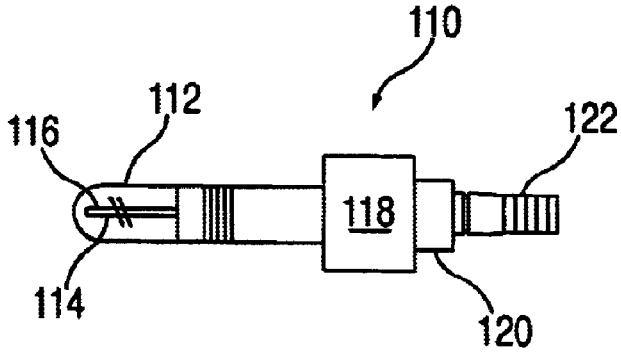
FIG. 2 is a side elevation view of a second embodiment of a lamp and ballast assembly according to the invention.

Turning now to FIGS. 2 and 2*a*, a lamp 110 according to the invention is similar to the lamp 10 described above with similar reference numerals referring to similar features. According to this embodiment, the lamp 110 is a 10–30 watt lamp, has an overall length of about 6 1/16 inches and a maximum width of about 3 3/16 inches.

Figure 3A:
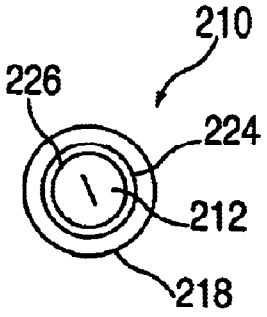
FIG. 3*a* is an end view of the lamp and ballast assembly of FIG. 3.
Figure 3:
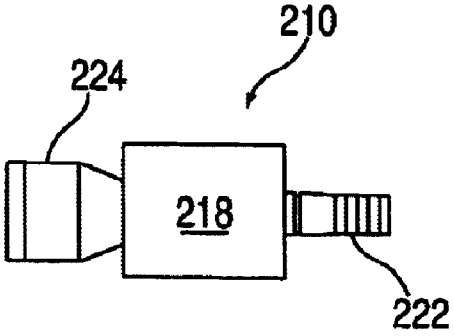
FIG. 3 is a side elevation view of a third embodiment of a lamp and ballast assembly according to the invention.

Turning now to FIGS. 3 and 3*a*, a lamp 210 according to the invention is similar to the lamp 10 described above with similar reference numerals referring to similar features. According to this embodiment, the glass envelope 212 is contained within a cylindrical protector 224 having a transparent window 226 and the ballast container 218 is also cylindrical. The lamp 210 is a 10–30 watt lamp, has an overall length of about 5 inches and a maximum diameter of about 2 3/8 inches.

Figure 4A:
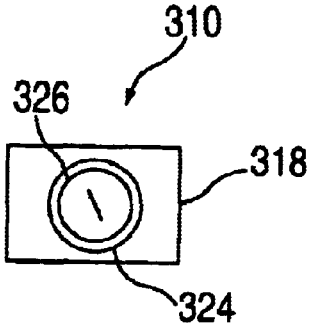
FIG. 4*a* is an end view of the lamp and ballast assembly of FIG. 4.
Figure 4:
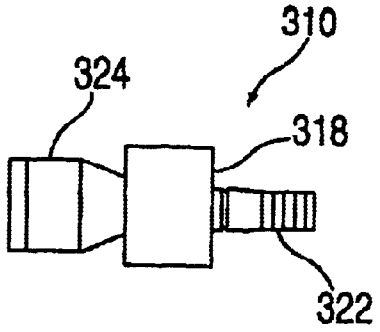
FIG. 4 is a side elevation view of a fourth embodiment of a lamp and ballast assembly according to the invention.

Turning now to FIGS. 4 and 4*a*, a lamp 310 according to the invention is similar to the lamp 210 described above with similar reference numerals referring to similar features. According to this embodiment, the ballast container 318 is rectilinear. The lamp 310 is a 10–30 watt lamp, has an overall length of about 5 inches and a maximum width of about 3 3/16 inches.

Figure 5A:
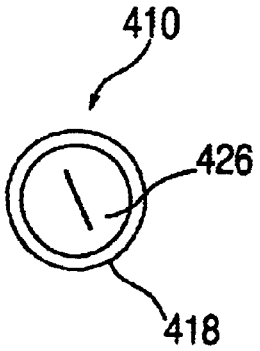
FIG. 5*a* is an end view of the lamp and ballast assembly of FIG. 5.
Figure 5:
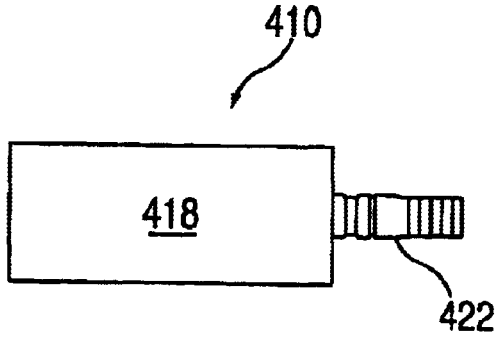
FIG. 5 is a side elevation view of a fifth embodiment of a lamp and ballast assembly according to the invention.

FIGS. 5 and 5*a* illustrate a lamp 410 which is housed in a monolithic cylinder 418 having a transparent window 426 at one end and a strain reliever 422 at its opposite end. The lamp 410 is a 10–30 watt lamp, has an overall length of about 5 5/18 inches and a maximum diameter of about 2½ inches. The monolithic cylinder is preferably hermetically sealed and waterproof to a predetermined depth. The monolithic cylinder is preferably hermetically sealed and waterproof to a predetermined depth.

Figure 6A:
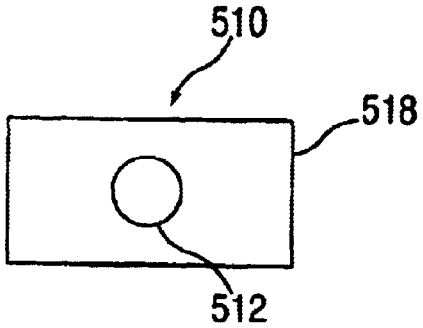
FIG. 6*a* is an end view of the lamp and ballast assembly of FIG. 6.
Figure 6:
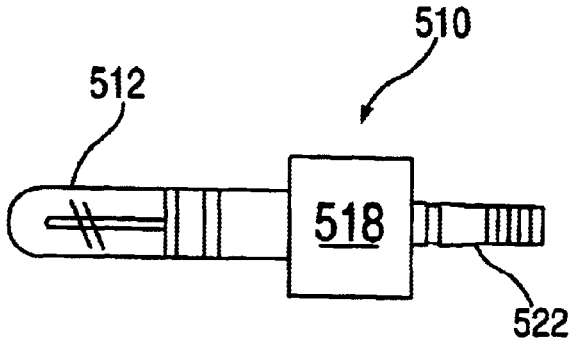
FIG. 6 is a side elevation view of a sixth embodiment of a lamp and ballast assembly according to the invention.

FIGS. 6 and 6*a* illustrate a lamp 510 which is similar to the lamps 10 and 110 described above. The lamp 510 is a 50–90 watt lamp, has an overall length of about 7.25 inches and a maximum width of about 5.187 inches.

Figure 7:
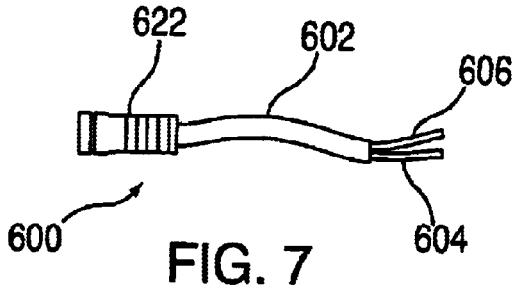
FIG. 7 is a side elevation view of a first embodiment of a cable connector.

Turning now to FIG. 7, a connector 600 according to the invention includes a cable 602 having free ends 604, 606 for relatively permanent coupling to a battery pack (not shown). The other end of the connector 600 has a strain relief 622 which is similar to the strain reliefs describe above.

Figure 8:
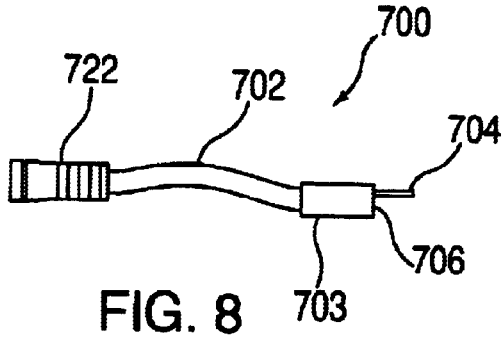
FIG. 8 is a side elevation view of a second embodiment of a cable connector.

FIG. 8 illustrates an alternate connector 700, which includes a cable 702 having a male/female connector 703 with a male contact 704 and a female contact 706 at one end thereof and a strain relief 722 at the other end thereof. The connector 700 is designed to be temporarily connected to a battery pack and swappable to another battery pack while under water ("wet pluggable") using a mating connector from the battery/power pack (not shown).

Figure 9:
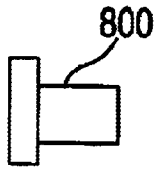
FIG. 9 is a side elevation view of a socket for use with the cable connector of FIG. 8.
Figure 9A:
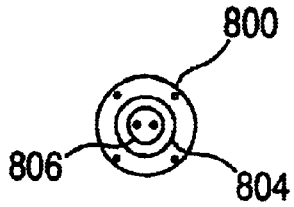
FIG. 9*a* is an end view of the socket of FIG. 9.

FIGS. 9 and 9A illustrate an alternate connection 800 which includes male contact 804 and female contact 806. The connector 800 is designed to be temporarily connected to a battery pack and swappable to another battery pack while under water (wet pluggable) using a mating connector from the battery/power pack.

FIG. 10 illustrates a lighting system 900 according to the invention. The system 900 includes a battery pack 901 and a lamp and ballast assembly 910. The ballast in the assembly 910 is coupled by a cable 902, having a connector 903 and a strain relief 922, to the battery pack 901. The assembly 910 is hermetically sealed and waterproof to a predetermined depth.

Figure 11A:
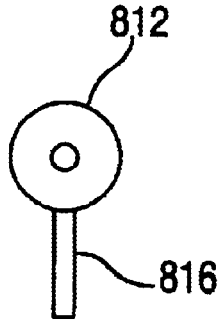
FIG. 11*a* is an end view of the invention shown in FIG. 11.
Figure 11:
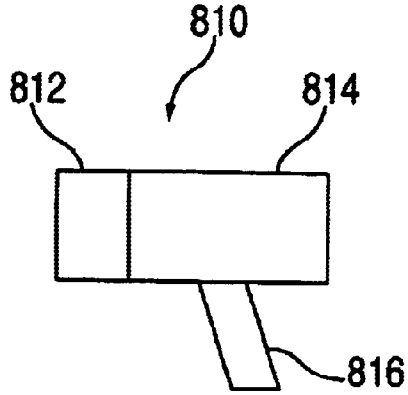
FIG. 11 is a side elevation view of a seventh embodiment of the invention showing a hand-held unit composed of a lamp ballast and battery.

FIGS. 11 and 11*a* illustrate a hand-held lamp 810 which is similar to lamps 10, 110, 510 described above. The lamp 810 is composed of a 10–20 Watt HID lamp and reflector assembly 812 which is coupled to a ballast and battery pack contained in housing 814 which is provided with a handle grip 816. The assembly has an overall length of 5" to 12" and a width or diameter from 2" to 6". Both dimensions will be dependent on the battery chemistry and size used.

Figure 12A:
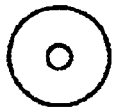
FIG. 12*a* is an end view of the unit shown in FIG. 12.
Figure 12:
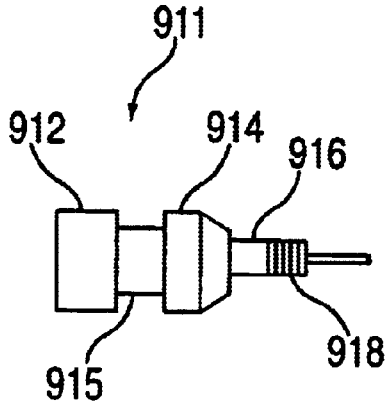
FIG. 12 is a side elevation view of an eight embodiment of the invention in the form of a head-mount or hand-held unit composed of a lamp and ballast.

FIGS. 12 and 12*a* illustrate a mini lamp 911 which is similar to lamp 10, 110, and 510 described above. The lamp 911 is composed of a 10–20 watt HID lamp and reflector assembly 912 which is coupled to a ballast contained in ballast housing 914 which, in turn, is provided with connector 916 and strain relief 918 to permit coupling to a remote battery pack (not shown). The lamp assembly has an overall length of 3¼". The ballast housing 914 is provided with a recessed center section 915 to allow the same to be releasably attached to a head clamp (not shown). Alternatively, it could be hand held.

There have been described and illustrated herein several embodiments of a high intensity discharge (HID) lamp with integral ballast and underwater lighting systems incorporating the same. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A high intensity discharge lamp assembly, comprising:

a) a high intensity discharge lamp comprising a hermetically sealed glass envelope containing a mixture of ionizable elements and/or compounds;

b) a sealed ballast container mounted adjacent to said glass envelope;

c) an electronic ballast contained in said container, said ballast having an input and an output;

d) an anode disposed in said envelope and electrically coupled to one pole of said ballast output;

e) a cathode disposed in said envelope and electrically coupled to another pole of said ballast output; and f) coupling means for coupling said input of said ballast to a DC power source;

g) heat sink means for dissipating heat from said ballast; and h) a waterproof protective container covering said envelope and said ballast container, said waterproof protective container having a transparent window.

2. A lamp assembly according to claim 1, further comprising:

i) a waterproof protective container covering said envelope, said waterproof protective container having a transparent window.

3. A lamp assembly according to claim 1, wherein:

said coupling means is a cable with a wet pluggable plug at one end for coupling/uncoupling to/from a battery pack while under water.

4. A lamp assembly according to claim 1, wherein:

said coupling means is cable with a pair of connectors at one end for coupling to a battery pack.

5. A lamp assembly according to claim 1, wherein:

said ballast container is potted with a thermally conductive epoxy, said epoxy serving as said heat sink means.

6. A lamp assembly according to claim 5, wherein:

said ballast container is made from a member selected from the group consisting of metal, plastic and/or a combination thereof.

7. An underwater lighting system comprising:

a) a high intensity discharge lamp comprising a hermetically sealed glass envelope containing a mixture of ionizable elements and/or compounds;

b) a sealed ballast container mounted adjacent to said glass envelope;

c) an electronic ballast contained in said container, said ballast having an input and an output;

d) an anode disposed in said envelope and electrically coupled to one pole of said ballast output;

e) a cathode disposed in said envelope and electrically coupled to another pole of said ballast output;

f) coupling means for coupling said input of said ballast to a DC power source;

g) heat sink means for dissipating heat from said ballast; and h) a waterproof protective container covering said envelope and said ballast container, said waterproof protective container having a transparent window.

8. An underwater lighting system according to claim 7, further comprising:

i) a waterproof protective container covering said envelope, said waterproof protective container having a transparent window.

9. An underwater lighting system according to claim 7, wherein:

said cable has a wet pluggable plug at one end and said power output of said battery pack has a wet pluggable socket.

10. An underwater lighting system according to claim 7, wherein:

said cable with a pair of connectors at one end permanently coupled to said power output of said battery pack.

11. An underwater lighting system according to claim 7, wherein:

said ballast container is potted with a thermally conductive epoxy, said epoxy serving as said heat sink means.

12. An underwater lighting system according to claim 11, wherein:

said ballast container is made from a material selected from the groups of metal, plastic or a combination thereof.

13. An underwater lighting system according to claim 7, wherein said ballast container is mounted within 18 inches of said glass envelope.

14. An underwater lighting system according to claim 7, further comprising:

i) a battery pack wherein said coupling means comprises a cable coupling said input of said ballast to said power output of said battery pack.

* * * * *

Disclaimer

6,679,619 B2 — Carl Saieva, 17 Sands La., Port Jefferson, NY (US) 11777. HIGH INTENSITY DISCHARGE (HID) LAMP WITH INTEGRAL BALLAST AND UNDERWATER LIGHTING SYSTEMS INCORPORATING SAME, Patent dated Jan. 20, 2004. Disclaimer filed March 30, 2004 by Inventor.

Hereby enter this disclaimer to claims 1, 2, and 8 of said patent.

*(Official Gazette, April 22, 2008)*

US006679619C1

(12) INTER PARTES REEXAMINATION CERTIFICATE (0261st)

United States Patent

Saieva

(10) Number: US 6,679,619 C1

(45) Certificate Issued: May 17, 2011

(54) HIGH INTENSITY DISCHARGE (HID) LAMP WITH INTEGRAL BALLAST AND UNDERWATER LIGHTING SYSTEMS INCORPORATING SAME

(75) Inventor: Carl Saieva, Port Jefferson, NY (US)

(73) Assignee: Sartek LLC, Dayton, OH (US)

Reexamination Request:
No. 95/000,060, Nov. 15, 2004

Reexamination Certificate for:

| | |
|---|---|
| Patent No.: | **6,679,619** |
| Issued: | **Jan. 20, 2004** |
| Appl. No.: | **09/783,767** |
| Filed: | **Feb. 15, 2001** |

Related U.S. Application Data

(60) Provisional application No. 60/183,767, filed on Feb. 18, 2000.

(51) Int. Cl.
*F21V 29/00* (2006.01)

(52) U.S. Cl. ..... 362/263; 362/261; 362/264; 362/267; 313/491

(58) Field of Classification Search ..... None
See application file for complete search history.

(56) References Cited

U.S. PATENT DOCUMENTS

| | | | | |
|---|---|---|---|---|
| 3,234,421 | A | | 2/1966 | Reiling |
| 3,965,287 | A | | 6/1976 | Mueller |
| 4,281,274 | A | | 7/1981 | Bechard et al. |
| 4,490,649 | A | | 12/1984 | Wang |
| 4,920,459 | A | | 4/1990 | Rothwell, Jr. et al. |
| 4,947,304 | A | * | 8/1990 | Payne et al. ..... 362/267 |
| 5,036,444 | A | | 7/1991 | Hiles |
| 5,072,347 | A | | 12/1991 | Brunson |
| 5,089,945 | A | | 2/1992 | Mula |
| 5,144,201 | A | | 9/1992 | Graham et al. |
| 5,381,322 | A | | 1/1995 | Humphreys |
| 5,416,676 | A | | 5/1995 | Carpenter |
| 5,493,484 | A | | 2/1996 | Osteen et al. |
| 5,548,497 | A | | 8/1996 | Cho |
| 5,604,406 | A | | 2/1997 | Gaus |
| 5,860,730 | A | | 1/1999 | Hesprich |
| 6,000,819 | A | | 12/1999 | Graber et al. |
| 6,174,074 | B1 | | 1/2001 | Lahijani |
| 6,175,487 | B1 | | 1/2001 | McCartney et al. |
| 6,467,930 | B1 | | 10/2002 | Frick |
| 6,679,619 | B2 | | 1/2004 | Saieva |
| 6,702,452 | B2 | | 3/2004 | Jigamian et al. |

OTHER PUBLICATIONS

Advanced Diver Magazine, Fall 1999, Issue 3, pp. 12–13.

Sartek Industries Inc., Have You Seen "The Light"? Advertisement (published Feb. 18, 2000 or earlier).

Sartek Industries Inc., HID18R & HID–18RW High Intensity Discharge Arc Light (published Feb. 18, 2000 or earlier).

Light & Motion Industries, Inc., "1997 Catalog & Selection Guide".

"NiMH–HID Technical," 1996 ("SunRay A") (collectively a part of the "SunRay References").

"Specification and Bill of Materials for SunRay HID," 1997 ("SunRay B") (collectively a part of the "SunRay References").

"Procedure for SunRay HID Ballast/Body Assembly," 1996 ("SunRay C") (collectively a part of the "SunRay References").

"Procedure for SunRay HID Gunking Assembly," 1996 ("SunRay D") (collectively a part of the "SunRay References").

(Continued)

*Primary Examiner*—Minh T Nguyen

(57) ABSTRACT

A portable battery powered high intensity lighting system that produces solar quality illumination at four to six times the efficiency of comparable incandescent lighting systems includes a light head and a power source. The light head contains an HID (high intensity discharge) arc lamp. A sealed enclosure containing a ballast is attached immediately adjacent to the lamp assembly. The ballast enclosure is preferably potted with a thermally conductive epoxy.

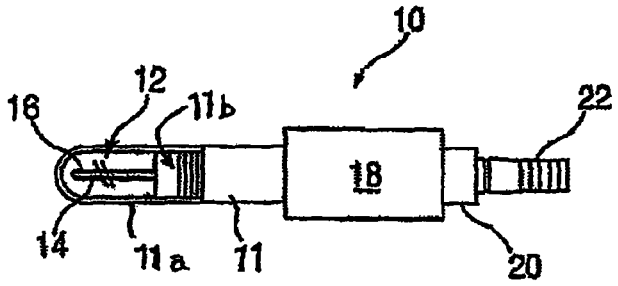

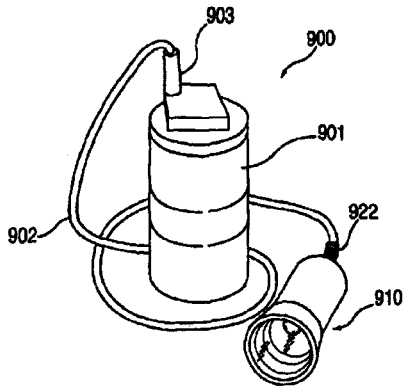

OTHER PUBLICATIONS

"1998 Catalog & Selection Guide" (Part of "SunRay E") (collectively a part of the "SunRay References").

Dive Training Magazine, Jul. 1997 (Part of "SunRay E") (collectively a part of the "SunRay References").

3 Cross–Section Photographs of SunRay HID (Reference Purposes Only).

Amended Complaint in *Sartek LLC et al.* v. *Larmartek Inc. et al.*

Declaration of Barrett Heywood Concerning the "SunRay References".

Oceans 82 Conference Record, "A Xenon Arc Light for the Johnson–Sea–Link Submersible," Washington, D.C., Sep. 20–22, 1982, pp. 349–354.

Advance Transformer Co., "Pocket Guide to High Intensity Discharge Lamp Ballasts," U.S.A., 1998.

Intervention Conference and Exposition 1989, "ROV Lighting with Metal Halide," San Diego, California, Mar. 1989, pp. 182–189.

Welch Allyn, Solarc Lamp Products, "Operation and Installation Manual," U.S.A., 1997.

Blackbirn Oceanographics "Blackbirn," Los Angeles, California,1981.

File Wrapper of U.S.Appl. No. 60/183,767.

File Wrapper of U.S. Appl. No. 6,679,619.

* cited by examiner

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, Line 57 to Column 4, Line 15:

Turning now to FIGS. 1, *1a* and 1[a]*b*, a lamp 10 according to the invention includes a hermetically sealed quartz glass envelope 12 containing an anode 14, a cathode 16, and *a* mixture of ionizable elements and/or compounds (not shown) *such as disclosed in referenced U.S. Pat. No. 5,144,201.* A sealed ballast container 18 is mounted immediately adjacent to the glass envelope 12. As shown in FIG. 1*b*, an electronic ballast 13 (schematically illustrated) having an input 20 and an output 15, is located in the sealed container 18 [and its]. *The* output 15 is electrically coupled to the anode 14 and *the* cathode 16 via *separate high voltage output* poles 17, 19, respectively, *through a lamp holder or support 11 which incorporates the high voltage output poles 17, 19. A tubular outer protective glass cover 11a surrounds the glass quartz envelope 12 and extends around the end of the lamp support 11, being held in place by O-ring seals 11b.* The ballast container 18, typically made of metal and/or plastic, is *located in close proximity to the quartz envelope 12 and is waterproof and pressure proof.*

*The container 18 can have mechanically pressure resistant walls, or* preferably, *is filled and sealed tightly by being* potted with a thermally conductive (electrically-non conductive) *insulator material. This material, such as an* epoxy insulator 21[which], *extends at least from the juncture of the lamp support 11 and the container 18* (*see FIG. 1b*) *and fills the interior of the container 18 around the ballast and related electronics. This material also* serves as a heat sink [discharge] *to extract* heat *away* from the [unit] *ballast 13 to the container 18. The potted, thermally conductive, electrically non-conductive insulator mass 21 surrounds, or substantially surrounds, the ballast 13 and related electronic components and extends rearward, e.g., to the right in FIG. 1, from the lamp support 11 and along the ballast input 20.* Alternatively, other heat sink arrangements (not shown) to dissipate heat from the ballast can be used.

The ballast input 20 is preferably coupled to a standard type of connector (FIGS. 7 and 8 described. below) so that the lamp 10 may be retro-fitted to an existing lighting system or a DC power source 901 via coupling means or cable 902 (FIG. 10). As shown in FIG. 1, a portion of the connector (otherwise not shown) includes a strain relief 22. As shown in FIG*S.* 1a *and 1b,* the ballast container 18 is rectangular in configuration *and surrounds the ballast 13 with a layer of the thermally conductive potting material 21.* According to this embodiment, the lamp 10 is a 10-30 watt lamp, has an overall length of about 8 3/16 inches, and a maximum width of about 2 3/16 inches.

AS A RESULT OF REEXAMINATION, IT HAS BEEN DETERMINED THAT:

Claims 1, 2, 5, 8, and 11 are cancelled.

Claims 3, 4, 6, 7, 12, and 14 are determined to be patentable as amended.

Claims 9, 10, and 13, dependent on an amended claim, are determined to be patentable.

3. A *high intensity discharge* lamp assembly[according to claim 1], [wherein]*comprising:*

*a high intensity discharge lamp comprising a hermetically sealed glass envelope containing a mixture of ionizable elements and/or compounds;*

*a sealed ballast container mounted adjacent to said glass envelope and including a support base adapted to receive and support said lamp, said ballast container being potted with a material to eliminate vacant spaces therein so that said potting material is in direct contact with the interior of said ballast container;*

*an electronic ballast within said ballast container, said ballast having an input and an output;*

*an anode disposed in said envelope and electrically coupled to one pole of said ballast output;*

*a cathode disposed in said envelope and electrically coupled to another pole of said ballast output;*

*coupling means for coupling said input of said ballast to a DC power source,* said coupling means [is] *being* a cable with a wet pluggable plug at one end for coupling/uncoupling to/from a battery pack while under water;

*heat sink means in said ballast container for extracting heat from said ballast and transferring said extracted heat to an exterior of said ballast container; and*

*a waterproof protective container covering said envelope and said ballast container; said waterproof protective container having a transparent window to transmit light from said lamp.*

4. A *high intensity discharge* lamp assembly[according to claim 1], [wherein]*comprising*:

a high intensity discharge lamp comprising a hermetically sealed glass *envelope containing a mixture of ionizable elements and/or compounds;*

*a sealed ballast container mounted adjacent to said glass envelope, said ballast container being potted with a material to eliminate vacant spaces therein so that said potting material is in direct contact with the interior of said ballast container;*

*an electronic ballast contained in said container, said ballast having an input and an output;*

*an anode disposed in said envelope and electrically coupled to one pole of said ballast output;*

*a cathode disposed in said envelope and electrically coupled to another pole of said ballast output;*

*coupling means for coupling said input of said ballast to a DC power source,* said coupling means *being* a [is] cable with a pair of connectors at one end for coupling to a battery pack;

*heat sink means for extracting heat from said ballast and transferring said extracted heat to an exterior of said ballast container and*

*a waterproof protective container covering said envelope and said ballast container, said waterproof protective*

*container having a transparent window for emission of light outside said lamp assembly.*

6. A lamp assembly according to claim [5] *4*, wherein: said ballast container is made from a member selected from the group consisting of metal, plastic and/or a combination thereof.

7. An underwater lighting system, comprising:

[a)]a high intensity discharge lamp comprising a hermetically sealed glass envelope containing a mixture of ionizable elements and/or compounds;

[b)]a sealed ballast container mounted adjacent to said glass envelope*, said ballast container being potted with a material to eliminate vacant spaces therein so that said potting material is in direct contact with the interior of said ballast container;*

[c)]an electronic ballast contained in said *ballast* container, said ballast having an input and an output;

[d)]Jan anode disposed in said envelope and electrically coupled to one pole of said ballast output;

[e)]a cathode disposed in said envelope and electrically coupled to another pole of said ballast output;

[f)]coupling means for coupling said input of said ballast to a DC power source;

[g)]heat sink means for [dissipating] *extracting* heat from said ballast *and passing said extracted heat to an exterior of said ballast container wherein said heat sink means comprises said material filling the interior of said ballast container;* and

[h)]a waterproof protective container covering said [envelope] *lamp* and said ballast container, said waterproof protective container having a transparent window *to transmit light from said lamp.*

12. An underwater lighting system according to claim [11] *7*, wherein: said ballast container is made from a material selected from the groups of metal, plastic or a combination thereof.

14. An underwater lighting system according to claim 7, further comprising: [i)] a battery pack wherein said coupling means comprises a cable coupling said input of said ballast to said power output of said battery pack.

* * * * *